US008442769B2

(12) United States Patent
Phillips et al.

(10) Patent No.: US 8,442,769 B2
(45) Date of Patent: May 14, 2013

(54) METHOD OF DETERMINING AND UTILIZING HIGH FIDELITY WELLBORE TRAJECTORY

(75) Inventors: Wayne J. Phillips, Houston, TX (US); Georgiy Bordakov, Richmond, TX (US); Alexander Kostin, Houston, TX (US); Shyam Mehta, Missouri City, TX (US); Denis Heliot, Missouri City, TX (US); John C. Rasmus, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 402 days.

(21) Appl. No.: 12/742,514

(22) PCT Filed: Nov. 11, 2008

(86) PCT No.: PCT/US2008/083135

§ 371 (c)(1),
(2), (4) Date: Jul. 19, 2010

(87) PCT Pub. No.: WO2009/064732

PCT Pub. Date: May 22, 2009

(65) Prior Publication Data

US 2010/0307742 A1 Dec. 9, 2010

Related U.S. Application Data

(60) Provisional application No. 60/987,298, filed on Nov. 12, 2007, provisional application No. 60/987,292, filed on Nov. 12, 2007.

(51) Int. Cl.
*E21B 47/022* (2012.01)

(52) U.S. Cl.
USPC ..... 702/6; 702/7; 702/9; 702/10; 702/11; 73/152.01; 73/152.02; 166/241.4; 166/255.1; 175/24; 175/45

(58) Field of Classification Search ..... 702/6, 7, 702/9, 10, 11; 73/152.54, 152.51, 152.43, 73/152.02, 152.01; 166/241.4, 250.01, 255.1, 166/255.2; 175/39, 40, 50, 27, 24, 45, 385, 175/406
See application file for complete search history.

(56) References Cited

U.S. PATENT DOCUMENTS 4,812,977 A 3/1989 Hulsing, II
5,113,953 A 5/1992 Noble (Continued)

FOREIGN PATENT DOCUMENTS

GB 2205980 12/1988
WO 2005033473 4/2005

OTHER PUBLICATIONS

Chia, C.R. et al., A New Method for Improving LWD Logging Depth, SPE 102175, San Antonio, TX, Sep. 24-27, 2006.

(Continued)

*Primary Examiner* — Carol Tsai
(74) *Attorney, Agent, or Firm* — Chadwick A. Sullivan

(57) ABSTRACT

Various methods are disclosed, comprising obtaining a plurality of raw depth measurements for a wellbore; obtaining survey data about a bottom hole assembly; obtaining depth compensation information; calculating a plurality of compensated depth measurements from the raw depth measurements and the depth compensation information and one or more additional corrections for residual pipe compliance, tide, and rig heave; calculating sag angle and correcting the survey data with the sag angle; determining a high fidelity wellbore trajectory from the compensated depth measurements and the survey data; and then employing the high fidelity wellbore trajectory in various drilling, formation evaluation, and production and reservoir analysis applications. Depth compensation information may comprise at least one of weight on bit, a friction factor, temperature profile, borehole profile, drill string mechanical properties, hookload, and drilling fluid property. The surveys may include both static and continuous surveys.

23 Claims, 6 Drawing Sheets

U.S. PATENT DOCUMENTS

| | | | | |
|---|---|---|---|---|
| 5,265,682 | A | 11/1993 | Russell et al. | |
| 5,520,255 | A | 5/1996 | Barr et al. | |
| 5,553,678 | A | 9/1996 | Barr et al. | |
| 5,553,679 | A | 9/1996 | Thorp | |
| 5,582,259 | A | 12/1996 | Barr | |
| 5,603,385 | A | 2/1997 | Colebrook | |
| 5,673,763 | A | 10/1997 | Thorp | |
| 5,685,379 | A | 11/1997 | Barr et al. | |
| 5,695,015 | A | 12/1997 | Barr et al. | |
| 5,706,905 | A | 1/1998 | Barr | |
| 5,778,992 | A | 7/1998 | Fuller | |
| 5,803,185 | A | 9/1998 | Barr et al. | |
| 5,971,085 | A | 10/1999 | Colebrook | |
| 6,000,277 | A * | 12/1999 | Smith et al. | 73/37 |
| 6,089,332 | A | 7/2000 | Barr et al. | |
| 6,092,610 | A | 7/2000 | Kosmala et al. | |
| 6,158,529 | A | 12/2000 | Dorel | |
| 6,244,361 | B1 | 6/2001 | Comeau et al. | |
| 6,364,034 | B1 | 4/2002 | Schoeffler | |
| 6,394,193 | B1 | 5/2002 | Askew | |
| 6,405,136 | B1 * | 6/2002 | Li et al. | 702/10 |
| 6,438,495 | B1 * | 8/2002 | Chau et al. | 702/9 |
| 6,633,816 | B2 * | 10/2003 | Shirasaka et al. | 702/6 |
| 6,750,815 | B2 * | 6/2004 | Michaelson et al. | 342/357.31 |
| 6,986,282 | B2 | 1/2006 | Ciglenec et al. | |
| 7,044,238 | B2 * | 5/2006 | Hutchinson | 175/50 |
| 7,274,989 | B2 * | 9/2007 | Hopper | 702/6 |
| 7,306,054 | B2 * | 12/2007 | Hutchinson | 175/45 |
| 7,316,278 | B2 * | 1/2008 | Hutchinson | 175/39 |
| 7,318,488 | B2 * | 1/2008 | Hutchinson | 175/40 |
| 7,886,844 | B2 | 2/2011 | Phillips | |
| 8,122,954 | B2 * | 2/2012 | Estes et al. | 166/255.1 |
| 2001/0052428 | A1 | 12/2001 | Larronde et al. | |
| 2002/0011359 | A1 | 1/2002 | Webb et al. | |
| 2005/0060096 | A1 * | 3/2005 | Hutchinson | 702/6 |
| 2005/0197777 | A1 * | 9/2005 | Rodney et al. | 702/9 |
| 2006/0073013 | A1 * | 4/2006 | Emigholz et al. | 416/35 |
| 2006/0185900 | A1 * | 8/2006 | Jones et al. | 175/26 |
| 2006/0266552 | A1 * | 11/2006 | Hutchinson | 175/50 |
| 2006/0266553 | A1 * | 11/2006 | Hutchinson | 175/50 |
| 2006/0272861 | A1 * | 12/2006 | Hutchinson | 175/50 |
| 2007/0110192 | A1 * | 5/2007 | Steiner | 375/343 |
| 2008/0105423 | A1 * | 5/2008 | Estes et al. | 166/250.01 |
| 2008/0236270 | A1 * | 10/2008 | Denichou et al. | 73/152.16 |
| 2009/0120690 | A1 | 5/2009 | Phillips | |

OTHER PUBLICATIONS

Bordakov, G.A. et al., Improving LWD Image and Formation Evaluation by Utilizing Dynamically Corrected Drilling-Derived LWD Depth and Continuous Inclination and Azimuth Measurements, SPE 109972, Nov. 11-14, 2007.

Prange, Michael D., Assessing Borehole-Position Uncertainty from Real-Time Measurements in an Earth Model, SPE 89781, Houston, TX, Sep. 26-29, 2004.

Canas, Jesus, Advanced Compositional Gradient Analysis, SPE 115429, Denver, CO, Sep. 21-24, 2008.

Stockhausen, E.J. et al., Continuous Direction and Inclination Measurements Lead to an Improvement in Wellbore Positioning, SPE 79917, Amsterdam, The Netherlands, Feb. 19-21, 2003.

J. Cook, et al, "Rocks Matter: Ground Truth in Geomechanics," Oilfield Review Autumn 2007, pp. 36-55.

A. Etchecopar, J.L. Bonnetain, "Cross Sections from Dipmeter Data," AAPG Bull 76(5), 1992, pp. 621-637.

S. Wang, J. Eaton, "Predicting Productivity Index of Horizontal Wells," Journal of Energy Resources Technology, Jun. 2007, vol. 129/89.

* cited by examiner

METHOD OF DETERMINING AND UTILIZING HIGH FIDELITY WELLBORE TRAJECTORY

RELATED APPLICATIONS

The present application claims priority to provisional U.S. Patent Application Ser. No. 60/987,292, filed Nov. 12, 2007, entitled "Continuous True Well Bore Trajectory Computation and Applications" to Phillips, et al, incorporated in its entirety by reference. The present application also claims priority to provisional U.S. Patent Application Ser. No. 60/987,298, filed Nov. 12, 2007, entitled "Formation Evaluation Applications Utilizing Dynamically Corrected Drilling Derived Depth and Continuous Inclination and Azimuth Measurements" to Bordakov, et al, incorporated in its entirety by reference.

The present disclosure may relate to U.S. Pat. No. 6,633,816 filed Jul. 31, 2001, entitled "Borehole Survey Method Utilizing Continuous Measurements," to Shirasaka, Phillips, and Tejada, incorporated in its entirety by reference.

The present disclosure may relate to the patent application WO 2005/033473 having a priority date of 1 Oct. 2003, entitled "System and Method for Correcting Errors in Depth for Measurements made While Drilling," by Walter Aldred, incorporated in its entirety by reference.

The present disclosure may relate to U.S. patent application Ser. No. 12/169,382 filed 8 Jul. 2008, entitled "Continuous Direction and Inclination for Wellbore Trajectory Surveys and Planning," to Wayne Phillips, incorporated in its entirety by reference.

TECHNICAL FIELD

The invention relates generally to the field of measurements made during the drilling phase of a hydrocarbon borehole. In particular, the invention relates to various applications enabled by the use of automated depth-compensated direction and inclination measurements.

BACKGROUND

FIG. 1 illustrates a general wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment a logging-while-drilling (LWD) module 120, a measuring-while-drilling (MWD) module 130, a rotary-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

One use of the system hereof is in conjunction with controlled steering or "directional drilling." In this embodiment, a rotary-steerable subsystem 150 (FIG. 1) is provided. Directional drilling is the intentional deviation of the wellbore from the path it would naturally take. In other words, directional drilling is the steering of the drill string so that it travels in a desired direction. Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well. A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course. A known method of directional drilling includes the use of a rotary steerable system ("RSS"). In a RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems. In the point-the-bit system, the axis of rotation of the drill bit is deviated from the local axis of the bottom hole assembly in the general direction of the new hole. The hole is propagated in accordance with the customary three point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953 all herein incorporated by reference. In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

FIG. 2 is a simplified diagram of a logging device, of a type disclosed in U.S. Pat. No. 6,986,282, incorporated herein by reference, for determining downhole pressures including annular pressure, formation pressure, and pore pressure, during a drilling operation, it being understood that other types of pressure measuring LWD tools can also be utilized as the LWD tool 120 or part of an LWD tool suite 120A. The device is formed in a modified stabilizer collar 1200 which has a passage 1215 extending there through drilling fluid. The flow of fluid through the tool creates an internal pressure $P_I$. The exterior of the drill collar is exposed to the annular pressure $P_A$ of the surrounding wellbore. The differential pressure $\delta P$ between the internal pressure $P_I$ and the annular pressure $P_A$ is used to activate the pressure assemblies 1210. Two representative pressure measuring assemblies are shown at 1210*a* and 1210*b*, respectively mounted on stabilizer blades. Pressure assembly 1210*a* is used to monitor annular pressure in the borehole and/or pressures of the surrounding formation when positioned in engagement with the wellbore wall. In FIG. 2, pressure assembly 1210*a* is in non-engagement with the borehole wall 1201 and, therefore, may measure annular pressure, if desired. When moved into engagement with the borehole wall 1201, the pressure assembly 1210*a* may be used to measure pore pressure of the surrounding formation. As also seen in FIG. 2, pressure assembly 1210*b* is extendable from the stabilizer blade 1214, using hydraulic control 1225, for sealing engagement with a mudcake 1205 and/or the wall 1201 of the borehole for taking measurements of the surrounding formation. The above referenced U.S. Pat. No. 6,986,282 can be referred to for further details. Circuitry (not shown in this view) couples pressure-representative signals to a processor/controller, an output of which is coupleable to telemetry circuitry.

Surveying of boreholes is commonly performed using downhole survey instruments. These instruments typically contain sets of three orthogonal accelerometers and magnetometers which are coupled within a bottom hole assembly (BHA), which is in turn coupled in the drillstring from 20 to 200 feet above the drill bit. These survey instruments are used to measure the direction and magnitude of the local gravitational and magnetic field vectors in order to determine the azimuth and the inclination of the borehole at each survey station within the borehole. Generally, discrete borehole surveys are performed at survey stations along the borehole when drilling is stopped or interrupted to add additional joints or stands of drillpipe to the drillstring at the surface, for example, approximately every 30 or 90 feet.

Rotating produces a generally linear trajectory of the drilled borehole, although there are typically borehole deviations from true linear trajectory due to the effects of gravity, geologic heterogeneities, misalignment between the BHA and the borehole, stiffness of the drillstring and transition effects that occur due to switching from one drilling mode to the other. Drilling while sliding produces a curved trajectory of the drilled borehole generally conforming to an arc. Again, there are typically borehole deviations from true arc configuration of a borehole segment drilled by sliding due to the same factors that cause borehole deviations from linear trajectory with drilling by rotating.

Many factors may combine to unpredictably influence the trajectory of a drilled borehole. It is important to accurately determine the borehole trajectory in order to determine the position of the borehole at any given point of interest and to guide the borehole to its geological objective. "Position," as that term is used herein in reference to boreholes, indicates the total vertical depth, longitude and latitude of a point of interest. Surveying of a borehole using existing methods involves the intermittent measurement of the earth's magnetic and gravitational fields to determine the azimuth and inclination of the borehole at the BHA under static conditions; that is, while the BHA is stationary. These "static" surveys are generally performed at discrete survey "stations" along the borehole when drilling operations are suspended to make up additional joints or stands of drillpipe into the drillstring. Consequently, the along hole depth or borehole distance between discrete survey stations is generally from 30 or 90 feet or more corresponding to the length of joints or stands of drillpipe added at the surface.

Reliable measurements of the earth's magnetic and gravitational fields are available at the survey stations, and can be used to obtain reliable estimates of the azimuth and inclination of the borehole at the survey stations. Although the azimuth and inclination at a survey station of interest can be determined using measurements of the earth's magnetic and gravitational fields, the true vertical depth cannot be measured directly by tools downhole, and must be determined by other means. The true vertical depth and position of a survey station is determined by mathematically combining the segments of the borehole between discrete survey stations starting with the surface location of the drilling rig and progressing downward to the geologic objective of the borehole. The problem is that undetected borehole variations occurring between discrete survey stations cause substantial errors in calculating the vertical depth and position of a survey station of interest. Undetected borehole variations accumulate as mathematical combination of borehole segments is used to calculate and track borehole vertical depth and position.

The survey instruments that reliably measure the earth's magnetic and gravitational fields at survey stations can also be used to obtain measurements of the earth's magnetic and gravitational fields. Drilling operations, as that term is used herein, means that the drill bit is being rotated against rock. Literally thousands of measurements of the earth's magnetic and gravitational fields can be obtained for each borehole segment using existing survey instruments. Successive measurements of the earth's magnetic and gravitational fields during drilling operations may be separated by only fractions of a second or thousandths of a meter and, in light of the relatively slow rate of change of the magnetic and gravitational fields in drilling a borehole, these measurements are continuous for all practical analyses. For this reason, the determination of azimuth and inclination of a borehole from measurements of the earth's magnetic and gravitational fields made are referred to herein as "continuous" measurements.

One or more survey stations may be generated using "discrete" or "continuous" measurement modes. Generally, discrete or "static" wellbore surveys are performed by creating survey stations along the wellbore when drilling is stopped or interrupted to add additional joints or stands of drillpipe to the drillstring at the surface. Continuous wellbore surveys relate to a multitude of measurements obtained while drill pipe is in motion using the survey instruments.

Known survey techniques as used herein encompass the utilization of a variety of methodologies to estimate wellbore position, such as using sensors, magnetometers, accelerometers, gyroscopes, measurements of drill pipe length or wireline depth, Measurement While Drilling ("MWD") tools, Logging While Drilling ("LWD") tools, wireline tools, seismic data, and the like.

Existing wellbore survey computation techniques use various methodologies, including the Tangential method, Balanced Tangential method, Average Angle method, Mercury method, Differential Equation method, cylindrical Radius of Curvature method and the Minimum Radius of Curvature method, to model the trajectory of the wellbore segments between survey stations. For each methodology, there is a trade-off between the relative complexity/simplicity of the calculation required to complete the survey, and the resulting resolution and degree of accuracy.

One problem is that the violent crushing and grinding of the drill bit against rock at the bottom of the borehole, the irregular interaction of the drillstring with the walls of the borehole, and even the constantly changing stresses in the connections between joints of drillpipe, all present during drilling operations, combine to contribute noise, shock and vibrations that severely contaminates continuously obtained measurements of the earth's magnetic and gravitational fields to the extent that this data is not useful in reliably determining the azimuth and inclination of the borehole at points between survey stations. If continuously obtained magnetic and gravitational field data could be effectively used, borehole deviations occurring between survey stations could be detected and accounted for in calculating and tracking the depth of the borehole.

Various considerations have brought about an ever-increasing need for more precise wellbore surveying techniques. More accurate survey information and true vertical depth is necessary at high resolution in measured depth to ensure the avoidance of well collisions (or alternatively, ensure intersection of wells) and the successful penetration of geological targets.

Despite the development and advancement of wellbore survey techniques in wellbore operations, there remains a need to provide highly accurate surveys and/or to use such data to perform additional functions. It is desirable that such techniques improve the efficiency of the drilling operation, including reducing rig time lost to stopping drilling. It is also desirable that such a system provide one or more of the following, among others: improved position accuracy, less wear on wellbore equipment, a smoother wellbore path, reduced lost in hole, modeling and/or predicting bit location, autonomous, semi-autonomous and/or closed loop drilling and correlating survey data with other wellbore data, and real time survey data.

As stated, it is desirable to save valuable drilling time, especially in low data rates conditions, where the survey transmission can take several minutes to the surface and some drillers cannot proceed without an accurate stationary survey. Such lost drilling time is cumulative and can add up to a substantial cost with new offshore rigs costs approaching million dollars a day.

SUMMARY

Various methods are disclosed, comprising obtaining a plurality of raw depth measurements for a wellbore; obtaining survey data about a bottom hole assembly; obtaining depth compensation information; calculating a plurality of compensated depth measurements from the raw depth measurements and the depth compensation information and one or more additional corrections for residual pipe compliance, tide, and rig heave; calculating sag angle and correcting the survey data with the sag angle; determining a high fidelity wellbore trajectory from the compensated depth measurements and the survey data; and then employing the high fidelity wellbore trajectory in various drilling, formation evaluation, and production and reservoir analysis applications. Depth compensation information may comprise at least one of weight on bit, a friction factor, temperature profile, borehole profile, drill string mechanical properties, hookload, and drilling fluid property. The surveys may include both static and continuous surveys.

Other or alternative features will become apparent from the following description, from the drawings, and from the claims.

DETAILED DESCRIPTION

Figure 1:
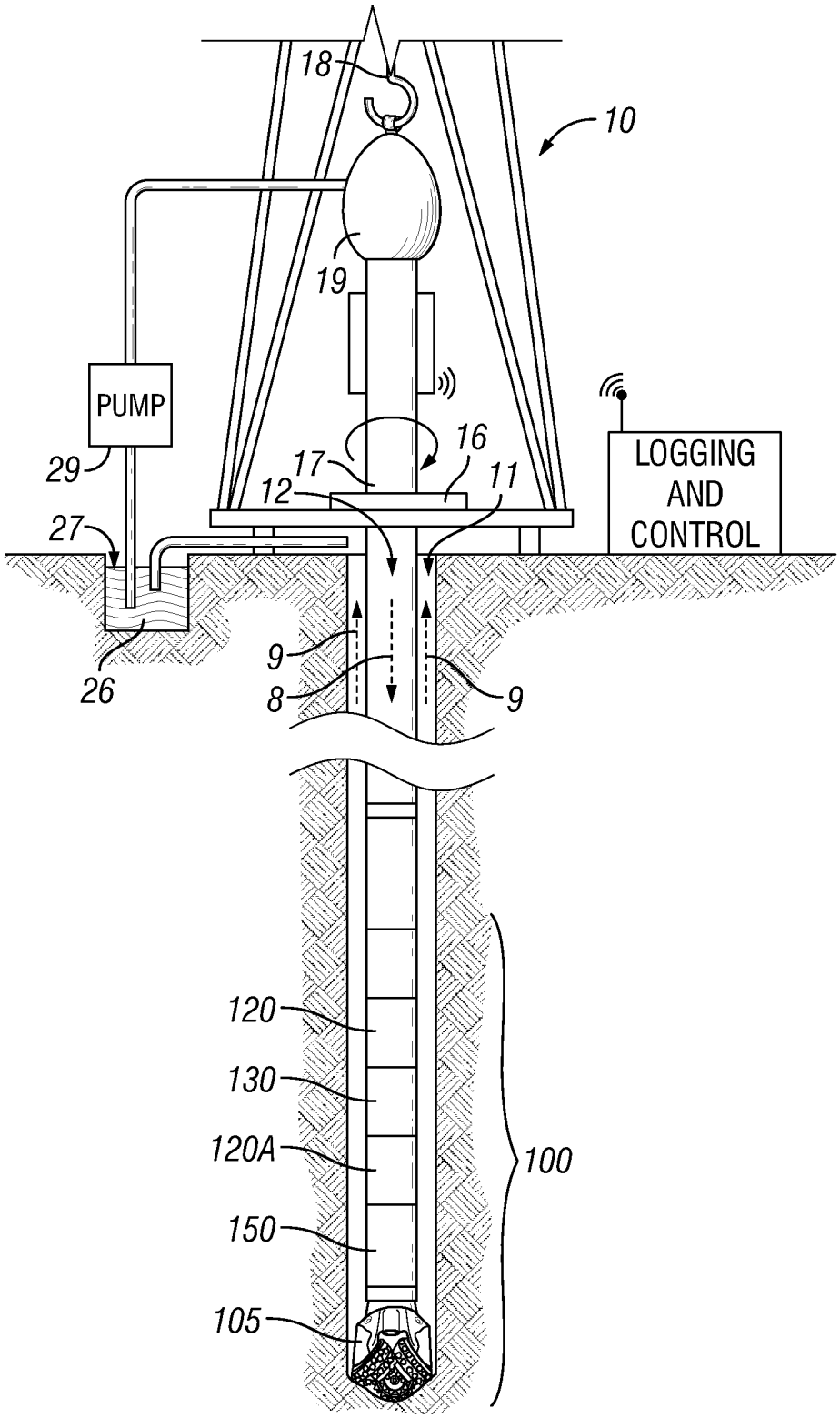
FIG. 1 illustrates a wellsite system in which the present invention can be employed.
Figure 2:
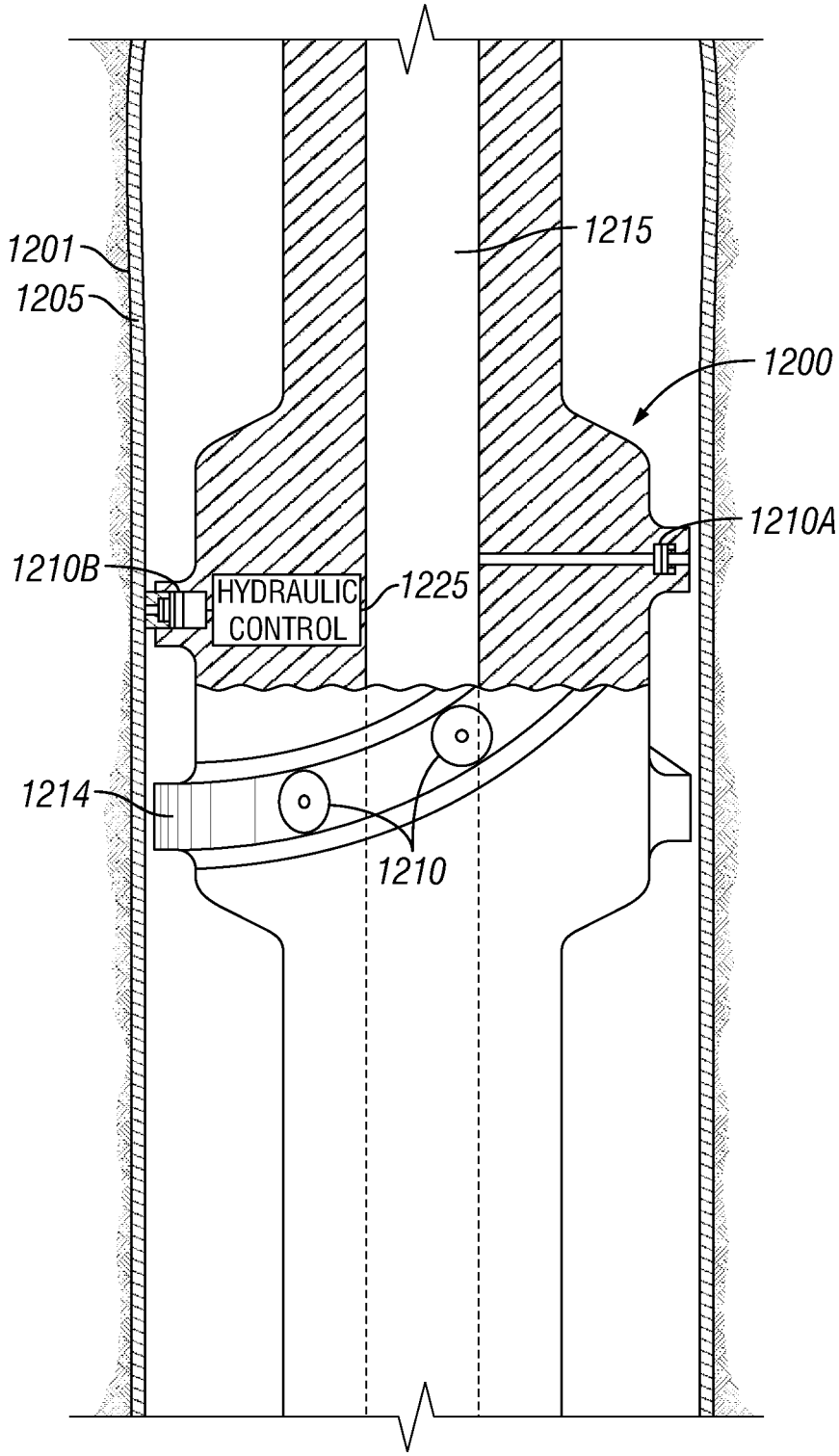
FIG. 2 depicts a simplified diagram of a logging device for determining downhole pressures during a drilling operation.

In the following description, numerous details are set forth to provide an understanding of the present invention. However, it will be understood by those skilled in the art that the present invention may be practiced without these details and that numerous variations or modifications from the described embodiments are possible.

Surveys, both static and continuous, are acquired as described above. The survey data, along with other measurements, may be compensated (i.e. depth corrected) with respect to the raw measured depth. To reduce possible human error depth correction calibration and quality estimation can be performed.

The depth corrected stationary and continuous survey data is then used as an input to a wellbore trajectory computation to obtain a high fidelity wellbore trajectory. Depth correction of stationary and continuous surveys enable computation of a high fidelity wellbore trajectory. The corrections for static vs. continuous surveys are different from one another because of different rig states and mechanical conditions, including for example, hookload, corresponding to stationary surveys and continuous direction and inclination measurements. Without such correction a systematic error, which accumulates with depth, will be introduced. The high fidelity wellbore trajectory, in turn, enhances various applications of surveys used in drilling, formation evaluation and production. Many of these applications are independent of mode of real time telemetry like mud pulse, electromagnetic telemetry, wireline, or wired drill pipe, etc. The high fidelity wellbore trajectory so calculated carries with it implications for enhanced drilling, including for example well placement, rig time savings, and activities required by the driller. The high fidelity wellbore trajectory also carries with it implications for enhanced formation evaluation, including calculating formation characteristics (in some cases, with additional measured physical quantities), production, and reservoir management, including determining quantities and rate of production at any given point in time, or over the life of the well, and fluid regime information.

Still another problem (in addition to those described above) in accurately determining depth based on surface measurements is the compliance of the pipe. That is, the compliance, or flexibility of the pipe, may influence the accuracy or interpretation of the measured depth, varying with drilling practices and formation properties. For example, if the driller uses constant rate of penetration (ROP), the weight on bit (WOB) will be greater for harder formations and less for softer, resulting in a significant change of the stretch value at the boundaries. For formation evaluation purposes, it is desirable, however, to preserve the same value of correction when entering a different formation. In another example, if the driller applies the brakes in steps, the WOB will express a drill-off pattern. Because static correction implies a constant WOB, its variations directly contribute to dynamic correction.

Two additional problems in accurately determining depth based on surface measurements, and therefore an accurate wellbore trajectory, are rig heave and tide. On a floater, rig heave may produce oscillations of about 3 feet in magnitude and 15-20 seconds in period. Even if a heave compensator is used, the residual rig heave observed may still be on the order of 4-8 inches. Tide also produces oscillations about 3 feet in magnitude, but with longer period of 6 to 12 hours. Tide sometimes does not affect LWD data, however, if the ROP is slow enough that tide half-period times ROP equals the offset between different LWD sensors in the BHA, e.g. resistivity and density, the effect may result in a loss of the correlation between the resistivity and density logs.

A source of inaccuracy in direction and inclination survey measurements is the sag angle. The sag angle is the angle between the vector tangent to the borehole, at the survey tool measure point, and the survey instrument axis. The misalignment is typically due to the sag of the MWD collar relative to the stabilizer(s) or the difference between borehole axis and MWD tool axis due to the sag of the MWD collar with respect to stabilizers. In continuous surveys, the sag angle can be changed further by WOB.

Each of the applications enhanced by the high fidelity wellbore trajectory will be discussed in turn herein.

Figure 3:
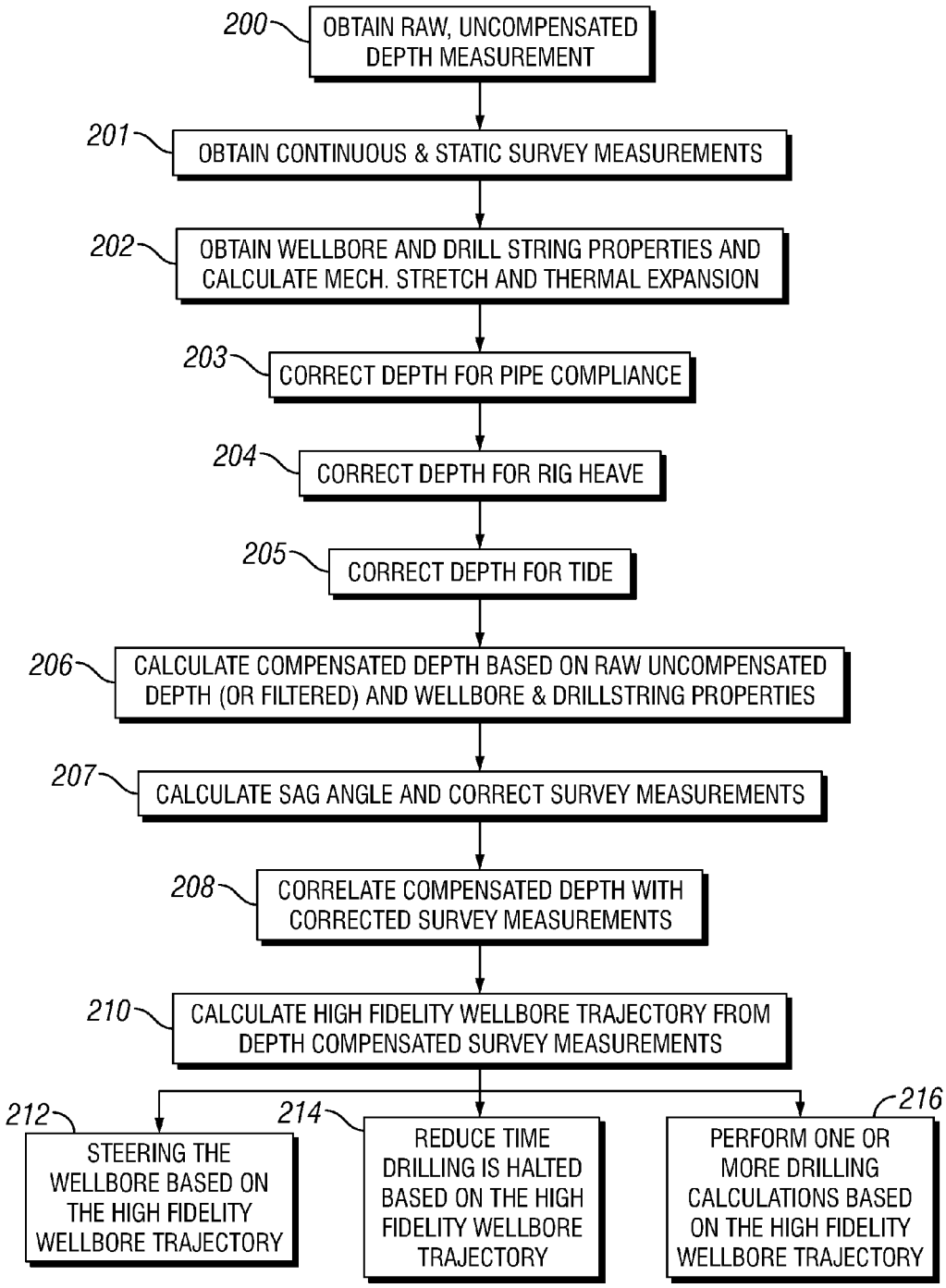
FIG. 3 illustrates a flowchart for a method in accordance with embodiments of the present disclosure for drilling applications enhanced by a high fidelity wellbore trajectory.

FIG. 3 illustrates a flowchart for a method in accordance with embodiments of the present disclosure for drilling applications enhanced by a high fidelity wellbore trajectory. Embodiments for various steps of the method for arriving at a high fidelity wellbore trajectory are discussed in U.S. Pat. No. 6,633,816 filed Jul. 31, 2001, entitled "Borehole Survey Method Utilizing Continuous Measurements," to Shirasaka, Phillips, and Tejada, incorporated in its entirety by reference (hereinafter "Tejada"), patent application WO 2005/033473 having a priority date of 1 Oct. 2003, entitled "System and Method for Correcting Errors in Depth for Measurements made While Drilling," by Walter Aldred (hereinafter "Aldred"), and U.S. patent application Ser. No. 12/169,382 filed 8 Jul. 2008, entitled "Continuous Direction and Inclination for Wellbore Trajectory Surveys and Planning," to Wayne Phillips (hereinafter "Phillips"). The order in which the data is obtained is not pertinent for patent purposes and embodiments in which the data is obtained in a different order or in any manner known by one of ordinary skill in the art are intended to fall within the scope of the present disclosure.

Generally, the workflow for enabling these new application and inventions consists of the following steps, each discussed more below:

1) Perform torque, drag, mechanical and thermal depth corrections to drill pipe using hookload measurement, BHA description, and static accepted surveys in the survey database.
2) Apply tide correction, rig heave correction, and/or pipe compliance filters.
3) Apply depth correction to the raw uncompensated static and Continuous Direction and Inclination ("CDNI") surveys, resulting in depth corrected surveys.
4) Apply rig state filter to static surveys, such that only the off bottom surveys are included in the next step.
5) Apply SAG correction to static and CDNI surveys to correct inclination.
6) Apply static-CDNI processing to incorporate the CDNI into the static survey data.
7) Recalculate the wellbore trajectory position.
8) Repeat steps 1-6 to refine the friction factors, corrected depths and final trajectory.
9) Compute the high fidelity wellbore trajectory position in 3D space.
10) Use the high fidelity wellbore trajectory to process the time based measurements into accurate depth based measurements using the existing workflows.

In step 200, raw, uncompensated depth measurements may be obtained. In some embodiments, the raw uncompensated depth measurements can be based on surface measurements made of pipe length before the pipe is disposed in the drillstring, after the pipe has been disposed in the drillstring, movement of the traveling block based on rig state, and/or other currently well-known methods for raw surface measurements. In step 201, during drilling we obtain surveys from the MWD tool, both continuous and static specifically a plurality of inclination and azimuth measurements. The measurements may be taken and updated in real time. In step 202, various wellbore and drillstring properties, including for example, temperature profile, the borehole profile including geometry, drillstring mechanical properties, friction factor and weight on bit (which vary depending on rig operation and driller input at the surface), hookload, fluid properties such as mud weight and composition may be obtained. From the wellbore and drillstring properties, mechanical stretch and thermal expansion depth correction associated with these properties may be calculated.

In step 203, an exponential filter is applied to the raw, uncompensated depth measurements to correct for pipe compliance. The exponential filter performs correction for residual terms due to compliance not already accounted for in step 202. Applying an exponential filter to the data adjusts the calculation of the high fidelity wellbore trajectory for the fact that the drilling is actually much smoother, and more regular than how it appears at the block at the surface. The exponential filter "relaxes" the movement at the block at the surface for a more accurately calculated depth, and therefore, high fidelity wellbore trajectory.

In step 204, optionally the filtered corrected depth (or the raw uncompensated depth measurements, in any case that pipe compliance corrections of step 203 are optionally not applied) from step 203 is further corrected for rig heave (at least in the cases of a floater rig). The inaccuracies introduced by the rig heave may be corrected by applying multi-pass median filter to the data acquired for depth. A median filter is a known filtering technique, however, the multi-pass median filter employed here for correcting for rig heave consists of taking a plurality of small windows instead of a single larger window, and using the median value in each small window to smooth out the measurements for depth.

In step 205, optionally the depth (either the filtered corrected depth from 203 or 204, or the raw uncompensated depth measurements) is further corrected for tide. The inaccuracies introduced by the tide may be corrected, for example, by adjusting the driller's depth with a tide chart.

The corrections for residual pipe compliance, tide and rig heave are each independent and may be performed in any order not necessarily in the order specified in FIG. 3. Any one of these three corrections may be applied alone or in any possible combination with the other two. In the most preferred embodiment, however, all three corrections are applied for the greatest degree of accuracy in the resulting high fidelity wellbore trajectory.

In step 206 the compensated depth is calculated based on corrected filtered depth (from 204, or in the case of a floater rig, from 205) and the wellbore and drillstring properties. In at least some embodiments, the computation of compensated depth is calculated as described in Aldred. In step 207, the sag inclination angle is calculated and added to the raw inclination of the survey measurements obtained in step 202.

Sag angle can be calculated according to various known calculations (i.e., using existing well geometry and survey, using user defined inclination and azimuth with software enabled tools such as DrillSAFE Drilling Office 3.1 RT) with knowledge of the BHA (i.e., the position of the direction and inclination sensor relative to other elements of the BHA such as stabilizers), well geometry with details of the casing used (depths, weights, and sizes), planned directional well path to be drilled, the mud weight, and formation stiffness. For continuous surveys, the sag angle calculation also requires knowledge of the varying WOB applied along the path surveyed.

The calculated sag angle is taken into account together with the raw inclination and azimuth to obtain the compensated inclination and azimuth of the wellbore. For example, the compensated inclination of the wellbore is equal to the inclination measured by the MWD tool plus the inclination sag angle. Under some circumstances, the calculated inclination sag angle may have a negative value (in that the pipe is bowing upward, rather than sagging), which simply results in the sag angle being subtracted from the raw inclination.

In step 208, the compensated depth calculated in step 207 is correlated with the corrected survey measurements from step 207. Such correlation may be in accordance, for example, with known mathematical regression models. From the compensated depth correlated with the survey measurements, a high fidelity wellbore trajectory is calculated 210. The high fidelity wellbore trajectory is a synthesis extrapolated from the survey data that has been smoothed for continuity as described in Tejada and corrected for more accurate depth as described in Aldred.

As alluded to above, the high fidelity wellbore trajectory enables various drilling applications, including steering the wellbore 212, reducing the time that drilling is halted 214, and performing one or more drilling calculations 216. With more specificity, the high fidelity wellbore trajectory, which is more accurate than well trajectories achievable with prior art methods, enhances steering the wellbore for well placement of one well relative to another, such as in Steam Assisted Gravity Drainage (SAGD) applications. The improvement comes from the better determination of the producer well position with respect to a known formation boundary and the ability to land the injector well closer (such as approximately 5 meters) and in a parallel placement relative to the producer well required trajectory, while reducing the probability of collision. Likewise, improvement comes from better knowledge of the placement of each of the wells, such that both wells can be placed carefully, relative to the other (which can be accomplished with or without various ranging techniques). Knowing the precise trajectory of the first well ahead of actually drilling the second (injector) well further enhances magnetic ranging for well placement of the second well. Though "first" and "second" are used herein generally to refer to the producing and injector well, respectively, the order of when the wells are drilled in time is not relevant, and the order of drilling may be reversed to the order described above.

The steering of step 212 may also comprise quantifying the risk of well collapse and mediating the risk. Knowing better trajectory, mud pressure, pressure gradient and rock properties versus depth from previous adjacent wells, the present disclosure allows for more accurate prediction for possible borehole collapse and therefore improves drillability in more complex geo-mechanical situations. Specifically, enhanced knowledge about the area around a particular well permits drillers to be more pro-active to prevent collapse. Modern industry practices for evaluating geo-mechanical situation include a variety of methods based on correlation of log and core measurements for multiple wells within the clusters defined on the basis of logs and surface measurements combined with geomechanical modeling (see for instance Cook, J, Frederiksen, R A, Hasbo, K, Green, S, Judzis, A, Martin, J W, Suarez-Rivera, R, Herwanger, J, Hooyman, P, Lee, D, Noeth, S, Sayers, C, Koutsabeloulis, N, Marsden, R, Stage, M G, and Tan, C P, 2007, Rocks Matter: Ground Truth in Geomechanics, Oilfield Review, Autumn 2007, pp 36-55.). For these well known industry techniques having positional measurement which is consistent for different logs, cores, pressure measurements at different wells and independent of trajectory, drillstring composition and drilling mode is paramount. Without such positional measurements LWD data can be only of very limited use for geo-mechanical purposes. The high fidelity wellbore trajectory described in the present disclosure improves the quality of, and therefore enables the usage of, LWD data, and therefore enhances real or relevant time geo-mechanical predictions. Specifically, the geo-mechanical knowledge about the area around a particular well enhanced with properly positioned LWD data permits drillers to be more pro-active (by taking known preventative measures not relevant to patentability here) to prevent collapse.

The step of steering the wellbore 212 may also comprise quantifying a probability of collision of the wellbore with a second wellbore. Specifically, industry standard wellbore position error models do not account for the effect of survey interval on position uncertainty. These models somewhat underestimate the uncertainty associated with standard surveys based on 90 ft survey intervals. This in turn will result in an underestimate of the risk of collision between two wellbores in close proximity and a potential increase in the likelihood of an actual collision. Use of the high fidelity wellbore trajectory mitigates or significantly reduces position errors induced by trajectory undulations between static surveys and the subsequent underestimate of collision risk. In various circumstances, it may be desirable to avoid collision, and in some circumstances, it may be desirable to actually cause collision (that is, intersection of at least two wells).

In step 214, the high fidelity wellbore trajectory is used to reduce the time that drilling is halted (and in some cases, time that the mud pumps are turned off). Static surveys are typically taken at 90 ft intervals when drilling is halted to add an additional 90 ft stand of drillpipe to the drillstring. 90 ft intervals between surveys are too large to capture all the undulations that take place during the drilling process, particularly if the drilling is bimodal as in alternating slide and rotary drilling. Continuous acquisition of survey data captures these undulations and yields a higher resolution trajectory measurement.

Similarly, one or more static surveys can be eliminated since a better trajectory can be determined from the continuous compensated data; saving rig time since drilling does not have to be halted.

The present disclosure achieves rig time savings by enabling the possibility of eliminating wireline runs (such as gyro measurements), and/or reducing the scope of wireline measurements. The main cause of this comes from the inaccuracies of measured depth, True Vertical Depth ("TVD") as will be explained in more detail below and trajectory in while drilling process as evaluated currently. Since the continuous surveys taken while drilling are compensated for depth, wireline or gyro runs once the well has been drilled can be rendered unnecessary.

The present disclosure achieves rig time savings by faster and more accurate determination of the position of the measurement point in the zone of interest for formation testing tools, as well as various sampling tools. Specifically, more accurate measurements mean that multiple measurements (or multiple attempts to actually place the tool properly) are avoided, saving rig time.

The present disclosure similarly achieves rig time savings by reducing the number of pressure test stations required to accurately determine the pressure gradient. The minimum number of pressure points required to determine the formation pressure gradient is typically two. However, due to uncertainties both in pressure and TVD depth measurements more stations are required to achieve acceptable level of pressure gradient accuracy. The bigger the error bars on a single pressure station, the more pressure stations are required. By providing more accurate TVD (see below), the present disclosure effectively reduces the depth error bar on every pressure station therefore reducing the minimum number of pressure tests required.

The step of performing drilling calculations 216 may further comprise calculations including determining the location of casing points relative to zonal boundaries, the location and severity of undulations and doglegs, and the length of the wellbore for determining the volume of cement or length of casing to use to complete the wellbore.

If the continuous trajectory is available in real-time it can be used by the Directional Driller (DD) to reduce the amplitude of the deviations from the well plan. The real-time continuous trajectory information allows the DD to quickly observe the reaction of the BHA to his steering commands rather having to wait until another 90 ft of wellbore has been drilled. This 'tighter' feedback loop allows the DD to see deviations from the plan as they develop and to more quickly correct them thus reducing their amplitude.

The high fidelity wellbore trajectory yields a better computation of the frictional loading on the drillstring. Micro doglegs in the wellbore trajectory increase the side loads on the drillstring with a resulting increase in frictional drag. Use of traditional static surveys might under estimate the frictional loading because the resulting trajectory does not include all the undulations actually in the wellbore. Good estimates of frictional loading are particularly important in high angle and horizontal wells where care must be taken to make sure there is sufficient weight in the drillstring in the low angle part of the well to overcome the friction in the high angle section so that sufficient weight is generated on the bit.

Knowledge of dogleg severity can also be critically important in assessing the ability to case a whole section. Since the diameter of the casing is typically close to the gage of the hole, the casing is stiffer than the drillstring used to drill the hole. Consequently, as the casing is bent into the shape of the borehole the side forces in sections with large doglegs can get so large the frictional drag prevents the casing from advancing. The high fidelity wellbore trajectory can identify whole sections where this is likely to occur and allow the well construction team to take some mitigating action like reaming whole sections with unacceptably high doglegs.

The combination of static surveys measured on raw measured depth that is driller's depth can significantly underestimate the actual length of the wellbore. Driller's depth (i.e., raw measured depth) ignores the fact that the drillpipe stretches under its own weight and that of the BHA and that it expands due to the elevated temperatures in the wellbore compared to the surface. The static surveys do not capture the undulations, or 'micro' doglegs, of the wellbore over the 90 ft interval between adjacent static surveys. Both the stretch of the drillpipe and the undulations between static surveys result in a wellbore that is longer than the value computed from a trajectory based on static surveys measured on driller's depth. Use of the high fidelity wellbore trajectory yields a more accurate estimate of the length of the wellbore since the drillpipe stretch and thermal expansion are estimated and the undulations are measured. This in turn yields better estimates for the length of casing needed to complete a whole section and the volume of cement needed to anchor it in place.

The drilling calculation in step 216 may also include an estimate of fatigue state, in order to avoid twist-off. While drilling through a curved section of borehole drillstring components are subjected to cycles of alternating mechanical strain. On every rotation the strain goes from compression to stretch and back to compression. These strain cycles induce fatigue and eventually mechanical failure. The number of cycles prior to failure depends on the magnitude of the strain, the more strain the fewer cycles before failure. The high fidelity wellbore trajectory captures 'micro' doglegs that are missed by the traditional static surveys on 90 ft intervals.

Consequently fatigue calculations based on the standard survey might underestimate the fatigue state of drillstring components and lead the crew to push them to failure with a resulting twistoff. The probability of underestimating the fatigue state of the drillstring will be reduce if the high fidelity wellbore trajectory is used to compute the magnitude of the bending induced strain on the drillstring components.

The high fidelity wellbore trajectory additionally enhances drilling automation—having a high density trajectory in real time enables more accurate projections of the bit position which helps in reducing the dog leg severity and tortuosity while achieving the plan by adjusting the drilling parameters at the surface, for example weight on bit, drillstring rotation, rotary steerable tool parameters, and pump pressure, or other adjustments made at surface.

Finally, the high fidelity wellbore trajectory significantly reduces or even eliminates effects of driller's mode of operation on logs, images and surveys, allowing the driller to freely apply the brakes or change drilling mode without effect on survey, logs, and images accuracy. Using the conventional raw measured depth that is driller's depth, we can end up with parts of depth log, which do not belong in their place, particularly, when a driller uses a brake. One example is to increase the bit load when the drillpipe moves on the surface, but the drill bit does not move downhole due to the brakes. In this case the depth log is filled with data corresponding to the same constant depth. The opposite case is a drill-off, when the drillpipe does not move on the surface but the drill bit moves downhole. In this case the acquisition system removes the part of the log where the drill-off happens and fills it with the logs from above. Even smaller variations of weight-on bit will always end up with relative stretching or shrinking of the depth log compared to the actual depth because of drillstring compliance to the force. These errors caused by weight-on-bit variations due to brakes being applied on and off or due to changes of the mechanical properties of the rock being drilled, cause the misinterpretation of the depth logs.

In addition to the errors caused by using conventional driller's depth, there are positional errors caused by industry accepted surveying practices. These errors have been described in "Stockhausen, E. J., and Lesso, W. G. Jr. 2003. Continuous Direction and Inclination Measurements Lead to an Improvement in Wellbore Positioning. Paper SPE 79917 presented at the SPE/IADC Drilling Conference, Amsterdam, Netherlands, 19-21 February". The magnitude of these errors also depends on the driller's mode of operation. Namely there are four main sources of surveying positional errors have been identified: 1) pattern slide/rotate directional drilling during build/drop and/or turn sections using positive displacement motors (PDM) steerable systems; 2) systematic use of PDM steerable systems to compensate for build, drop and walk BHA tendencies while maintaining constant inclination and azimuth in a tangent well section; 3) changing modes with rotary steerable systems (RSS) between stationary survey points; and 4) formation mechanical property changes between stationary survey points.

If the high fidelity wellbore trajectory is not applied, there is only a narrow set of possible drilling regimes in which there is no significant adverse effect on the quality of logs and positional measurements. To eliminate the errors, driller should always maintain constant weight-on-bit and take a survey every time when PDM or RSS drilling mode is changed as well as formation mechanical properties are changed significantly. Automated drilling systems may have and typically do have different criteria to optimize such as rate of penetration and eventually a rig operations time. Optimizing these criteria will have and adverse effect on logs and positional measurements and can eventually render these measurements misleading. For these reasons, the enhanced automated drilling is vastly enhanced by incorporating the high fidelity wellbore trajectory determined in step 210. These depth corrections along with continuous survey measurements allow better optimization of the rig operations time while minimizing errors in logs and positional measurements to within a desired range.

Figure 4:
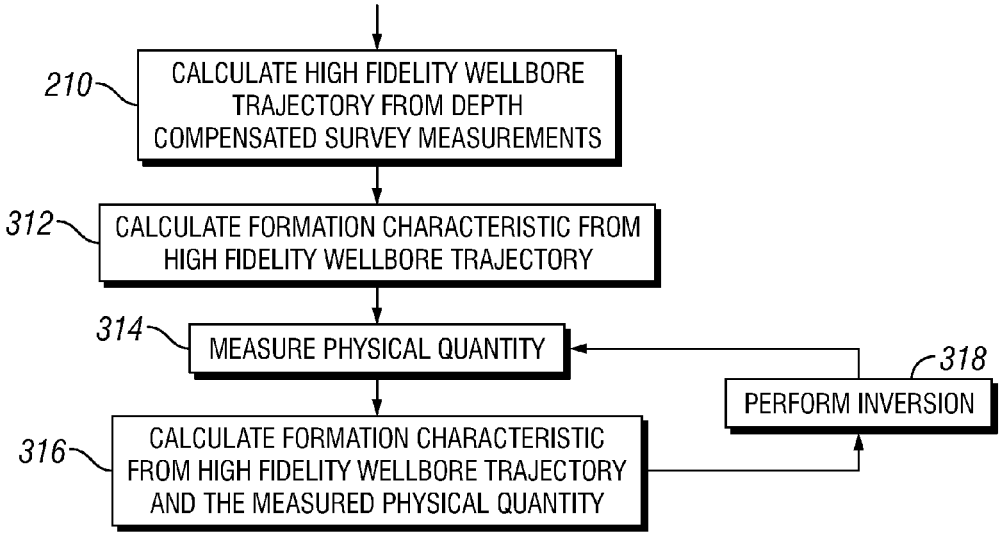
FIG. 4 depicts a flowchart for a method in accordance with embodiments of the present disclosure for formation evaluation applications enhanced by a high fidelity wellbore trajectory.

FIG. 4 depicts a flowchart for a method in accordance with embodiments of the present disclosure for formation evaluation applications enhanced by a high fidelity wellbore trajectory. Steps of the method 200 through 210, that is, the steps for arriving at the high fidelity wellbore trajectory are the same steps as discussed above with respect to FIG. 3 for the drilling applications. Once the high fidelity wellbore trajectory is calculated, a formation characteristic may be calculated. The formation characteristic may comprise a determination made directly from the synthesized depth compensated continuous (i.e. high fidelity) wellbore trajectory such as true vertical depth, or a characteristic of a particular stratigraphic layer within the reservoir, such as true vertical thickness or true stratigraphic thickness between two points in the reservoir, the two points selected based on some additionally measured physical quantity that defines the stratigraphic layer, which may be measured in step 314.

Other formation characteristics may include, for example, apparent dip, absolute dip, pressure gradient, compositional gradient, and the location of fluid contact boundaries. The apparent dip computation is enhanced over prior art techniques by use of the high fidelity wellbore trajectory, in that the trajectory so determined improves positioning of all features on the borehole images. Likewise, the absolute dip computation is enhanced by use of the high fidelity wellbore trajectory, both because of the improvement of the apparent dip and of the orientation of the borehole axis. Advantages to apparent dip and absolute dip computation are discussed in more detail below.

Some formation characteristics are not determined solely from the high fidelity wellbore trajectory, but are additionally based on some measured physical quantity that is indicative of a property of the formation such as resistivity, porosity, permeability, density, rock strength, slowness, fluid saturation, chemical composition, pressure, and the like. Such physical quantities are measured at step 314 and the formation characteristic (of the sort that cannot be determined solely from the synthesized high fidelity wellbore trajectory) is calculated in step 316 based on the measured physical quantity and the high fidelity wellbore trajectory. For example, in step 314, pressure may be the physical quantity that is measured, and based on a plurality of pressure measurements, a pressure gradient may be calculated in step 316. The present disclosure improves formation evaluation by ensuring that the different measurements of physical quantities performed at different points along the BHA are compensated "in depth" for further processing, in particular volumetric analysis and/or facies determination.

Similarly, a compositional gradient may be determined from a plurality of measurements and the high fidelity wellbore trajectory. Improved positioning enabled by the present disclosure allows better interpretation of compositional gradients. Methods to analyze compositional gradient are described in SPE 115429 Cana J., Pop J., Dubost F., Eishahawi H. "Advanced Compositional Gradient Analysis". These methods rely on an accurate and precise determination of the pressure gradients, which the present disclosure make possible for LWD data.

A plurality of measurements of physical quantities enables inversion, as is well known in the art, and with the high fidelity wellbore trajectory, the resulting inversion is more accurate compared with the prior art. At 314, a physical quantity or quantities are measured and from the measurements and the high fidelity wellbore trajectory a formation characteristic can be determined at 316, and inversion at 318 is performed to arrive at an earth model of the formation, as discussed further here. As would be known by one of ordinary skill in the art, inversion may include calculation from a manual iteration to an automated computer-aided process or a combination of the two. One of the modern methods of reducing wellbore position, formation geometry and properties uncertainty is examining the wellbore position in the context of an earth model through the use of log measurements. The uncertainty improvement is based on steering the well using various markers such as depth markers, dip markers, stratigraphic markers and in-layer markers (see Prange, M., Tilke, P. and Kaufman, P., 2004, Assessing Borehole Position Uncertainty From Real-Time Measurements in an Earth Model, SPE 89781, presented at the 2004 ATCE in Houston). Steering is performed based on comparison of modeling and inversion results for logging tools (primarily propagation resistivity, but also nuclear acoustic and seismic) and actual measurements. Modeling and inversion accuracy increases with the increase of tool (or tool parts) position accuracy, that is with the accuracy of a trajectory point relative to other. The improved the trajectory accuracy of the high fidelity wellbore trajectory in accordance with the present disclosure improves the accuracy of the inversion of resistivity and other formation measurements, resulting in more accurate formation geometry and properties.

The high fidelity trajectory in accordance with the present disclosure additionally powers a more accurate determination of formation anisotropy orientation (for example, acoustic and electromagnetic anisotropy). The orientation of formation anisotropy is defined by the true dip and true azimuth. A formation evaluation tool performs anisotropy measurements in the reference system aligned with the borehole axis resulting in the apparent dip and azimuth measurements. High fidelity trajectory ensures better measurement of the apparent dip and azimuth as described below. In addition, to perform conversion from apparent to true dip and azimuth the direction of the borehole axis at each measurement point is required. The high fidelity wellbore trajectory provides for more accurate measurement of the borehole axis orientation at each measurement point.

The high fidelity wellbore trajectory also facilitates time-lapse processing and interpretation of LWD data by bringing those data in depth. Having data corrected or compensated for depth is particularly important for time-lapse interpretation in real time (in time for making a decision) and detection of where and when invasion take place, which can be used to identify permeable zones. The present disclosure high fidelity wellbore trajectory also facilitates correlation of measured physical quantities and calculated formation characteristics with one or more wireline logs.

Figure 5:
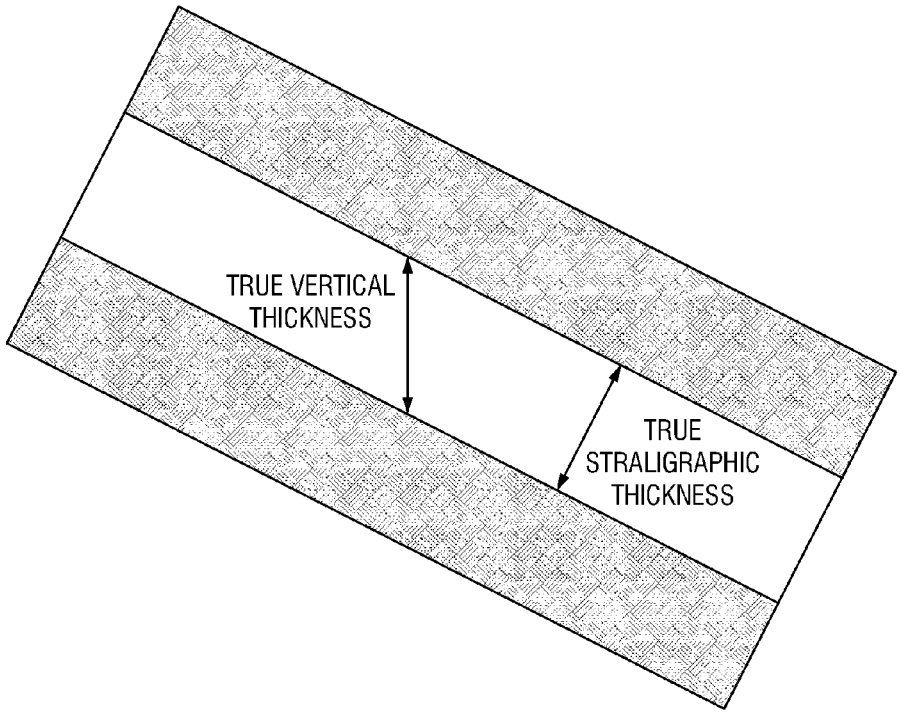
FIG. 5 illustrates physically quantities calculated in accordance with embodiments of the present disclosure, including true vertical thickness and true stratigraphic thickness.

FIG. 5 illustrates formation characteristics calculated in accordance with embodiments of the present disclosure, including true vertical thickness and true stratigraphic thickness, as described with respect to step 312 in FIG. 4. The high fidelity wellbore trajectory as calculated in step 210 results in more accurate determinations of True Vertical Depth (TVD), True Vertical Thickness (TVT) and True Stratigraphic Thickness (TST), as illustrated in FIG. 5. These more accurate determinations of TVD, TVT, and TST have implications for all the volumetric calculations such as pay zone thickness, oil-in-place, and the like.

The term "True Vertical Depth" describes the vertical distance from a point in a well to a reference point at surface and is calculated using direction and inclination survey stations located above this point assuming a certain borehole profile between stations (for example, minimum curvature). The error introduced in direction and inclination or depth measurements at any survey station or any discrepancy between the assumed and actual wellbore profile contributes to the overall error in TVD. The high fidelity wellbore trajectory as calculated in step 210 results in greater depth and direction and inclination accuracy at each survey station as well as provides continuous trajectory measurement (no need to assume a certain profile between stations) which results in more accurate TVD calculation.

The term "True Vertical Thickness" describes the thickness of a bed or rock body measured vertically at a point (see FIG. 5). TVT allows calculation of the actual hydrocarbon column height from logging data acquired in deviated boreholes. TVT is can be derived from well trajectory and the dip/azimuth of the formation layer. The high fidelity wellbore trajectory as calculated in step 210 results in the improved accuracy of TVT calculations in a manner similar to TVD.

The term "True Stratigraphic Thickness" describes the thickness of a bed or rock body after correcting for dip of the bed or body and the trajectory of the well (see FIG. 5). Since TST calculation is also based on the well trajectory, the current high fidelity wellbore trajectory as calculated in step 210 results in the improved accuracy of TST calculation in a manner similar to TVD.

The improved positioning provided by the high fidelity wellbore trajectory allows improved interpretation of pressure gradient measurement, differentiating between formation induced pressure variations versus TVD. Pressure gradient interpretation typically involves pressure data from multiple wells in the same field. Multi-well pressure gradient data interpretation provides answers to the extent of lateral connectivity of the reservoir, location of fluids contacts, likelihood of reservoir compartmentalization. Such analysis is performed versus TVD depth. Pressure gradient errors due to TVD uncertainty may significantly impair such interpretation. By improving the accuracy of TVD calculation with the high fidelity wellbore trajectory, the present disclosure allows for more accurate formation pressure analysis.

The high fidelity wellbore trajectory also results in improved positioning for fluid boundaries, oil-gas, oil-water and water-gas contacts on the reservoir scale. In a particular well, the positions of such fluid contact boundaries are determined based on pressure measurements at certain depths and assumption of pressure equilibrium at the boundary. With prior art methods, uncertainty in TVD produces significantly increased uncertainty in the oil-water contact position. The uncertainty is increased by a factor which is ratio of the density of oil (or water) to difference of densities of water and oil. Comparison of fluid contact boundary positions for different wells requires TVD measurement which is consistent between wells and independent on trajectory, drillstring composition and drilling mode. Current LWD positional measurement does not have these properties and therefore can lead to erroneous conclusions of fluid contacts geometry. The high fidelity wellbore trajectory presented here enables such consistency and independence properties. In addition to improving boundary position uncertainty for a single well, the high fidelity wellbore trajectory allows to one to judge if the reservoir is compartmentalized and improves the quality of reservoir simulation due to the fact that we know with an improved accuracy whether a fluid contact is flat or tilted.

Figure 6A:
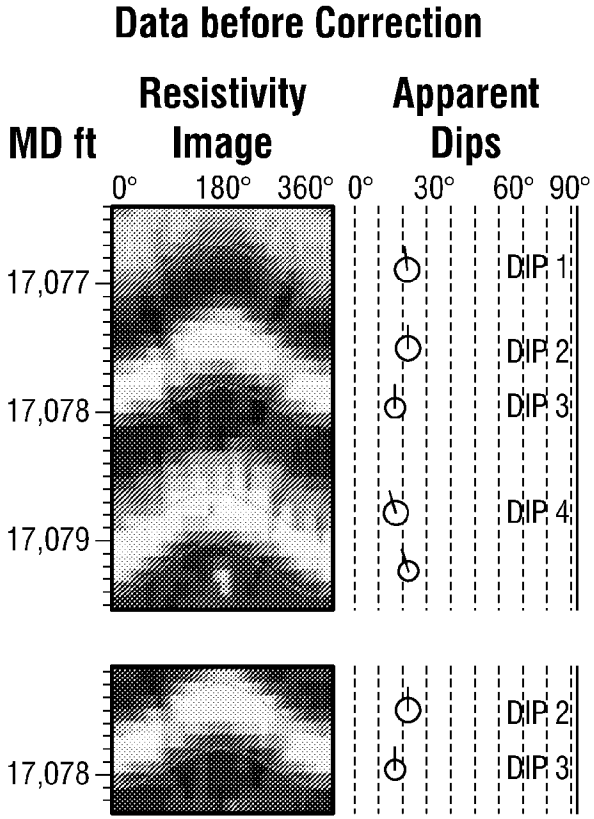
FIG. 6 depicts individual dip measurements, before and after, as affected by the drillstring length variations due to the compliance to the variable forces such as weight-on-bit and friction.
Figure 6B:
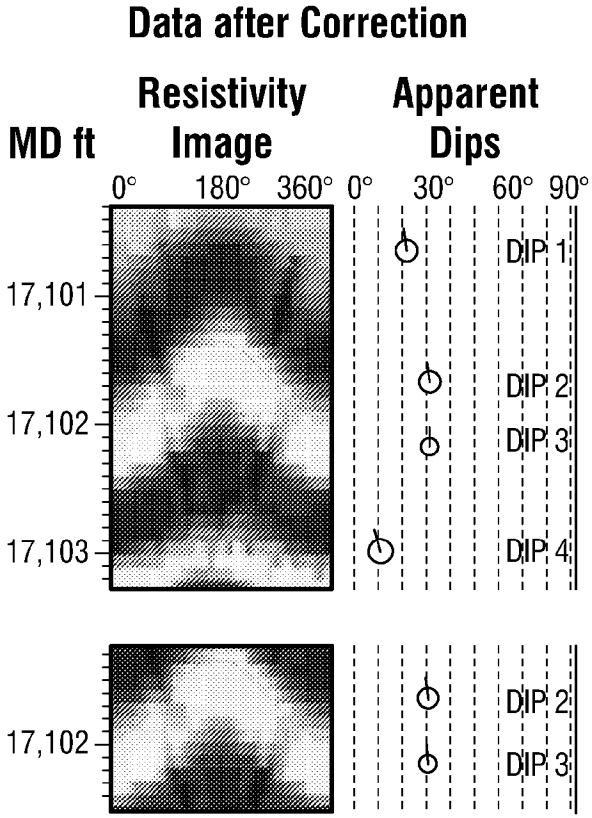

FIG. 6 depicts individual dip measurements, before and after, as affected by the drillstring length variations due to the compliance to the variable forces such as weight-on-bit and friction. Similar to the apparent dip and azimuth of the bed boundary intersecting the borehole, apparent dip and azimuth of the formation anisotropy are subject to the same geometric errors resulting from the drillstring length variations.

The high fidelity wellbore trajectory results in improved accuracy of dip determination for more consistent and accurate determination of geological properties (such as fault characteristics and regional dip) and therefore enables a more reliable geological model of the reservoir. Currently in the industry these characteristics are determined based on cross section analysis of the dips determined by dipmeter tools or by images (see Etchecopar, A., Bonnetain, J.-L. 1992. Cross Sections from Dipmeter Data. *AAPG Bull.* 76(5): 621-637.). Individual dip measurements are affected by the drillstring length variations due to the compliance to the variable forces such as weight-on-bit and friction. FIG. 6 illustrates possible changes in the dip angle values when this compliance is taken into account. For example in a 5 km long 8.5" diameter borehole with 0-30° inclination variation of weight-on-bit of 1000 kgf over the time when the formation boundary is logged (which is quite typical even for constant weight-on-bit drilling) will cause 5-8° error in the apparent dip value. Greater weight-on-bit variations will cause greater errors, which are almost proportional in value to the weigh-on-bit variation. These errors caused by changing drilling regimes will lead to misinterpretation of geological properties since the errors are significant and cross section analysis will treat them as inheret to the geology rather than drilling, which they are actually. Elimination of these errors (by employing the high fidelity wellbore trajectory) improves the accuracy of the cross section analysis. Similarly employing the high fidelity wellbore trajectory improves the accuracy of the formation anisotropy measurements.

Figure 7:
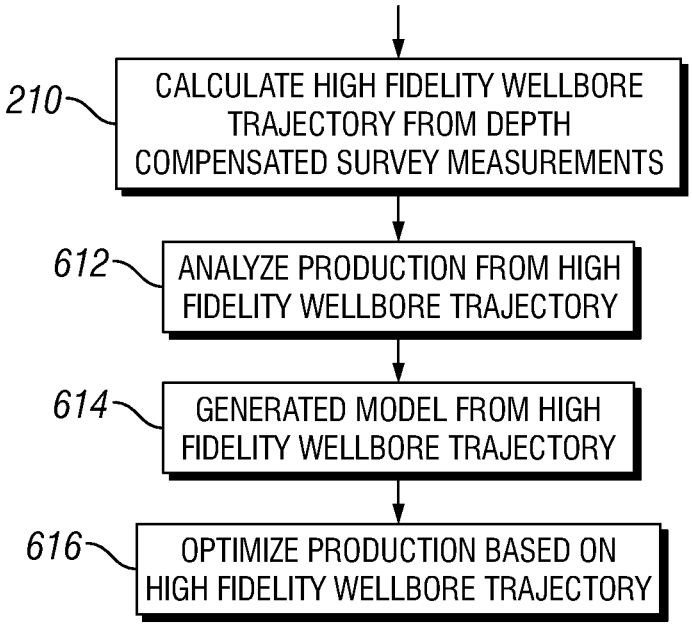
FIG. 7 illustrates a flowchart for a method in accordance with embodiments of the present disclosure for production applications enhanced by a high fidelity wellbore trajectory.

FIG. 7 illustrates a flowchart for a method in accordance with embodiments of the present disclosure for production applications enhanced by a high fidelity wellbore trajectory. Steps of the method 200 through 210, that is, the steps for arriving at the high fidelity wellbore trajectory are the same steps as discussed above with respect to FIG. 3 for the drilling applications. Once the high fidelity wellbore trajectory is calculated, production can be analyzed from the trajectory in step 612. Production analysis can range to include various activities, including optimizing the quantity or rate of production at any given point in time or across the life of the well, determining flow regime and generating a model of the flow regime, determining reservoir depletion rate, and analyzing fluid contact boundaries and fluid contact dynamics over time.

The high fidelity wellbore trajectory enhances prediction and analysis of the production in a given layer based on the position of the trajectory within that layer (See for instance: Wang S., Eaton J. "Predicting Productivity Index of Horizontal Wells", Journal of Energy Resources Technology, June 2007, Vol. 129/89). For example, production may be maximized by placement of the well near the top, middle, or bottom of a reservoir depending on the particular geometry of the formation. This improved prediction and analysis allows, in turn, more informed decisions on completion, future well placement, enhanced oil recovery (EOR) techniques, etc. In the case where different drilling equipments are considered (e.g:, whether to use rotary steerable equipment), the benefit of a better positioned more accurate high fidelity wellbore trajectory can be quantified in terms of productivity gain.

The high fidelity wellbore trajectory results in better, more accurate modeling of flow in the well, in particular in case of near-horizontal and horizontal wells. The flow regime in the particular part of the well is highly sensitive to the inclination of the borehole with respect to the horizontal. A mere one degree change can lead to a completely different flow regime and significantly affect production. The more accurate depth compensated inclination of the well according to methods of the present disclosure enhances the ability to predict the regime of the flow in the near-horizontal and horizontal sections of the wells.

The high fidelity wellbore trajectory enables better interpretation of the fluid contact dynamics as fluids move while the reservoir is being produced. Fluid contact dynamics is studied by performing open-hole or cased-hole measurements in a single well or a number of wells in the reservoir, after which the data are analyzed in TVD space. The methods of the present disclose allow more accurate conversion of the measured data from measured depth MD to TVD and hence improves interpretation thereof.

The high fidelity wellbore trajectory also results in a better, more accurate measurement of reservoir depletion rate from pressure gradients change over time. Pressure gradients are studied in TVD space. The present disclosure allows more accurate conversion of the measured data from measured depth MD to TVD and hence improves interpretation thereof.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A method for obtaining a high fidelity wellbore trajectory, comprising:

obtaining a plurality of raw depth measurements of a wellbore;

obtaining survey data about a bottom hole assembly;

obtaining depth compensation information;

correcting the plurality of raw depth measurements for residual pipe compliance;

calculating a plurality of compensated depth measurements from the raw depth measurements, the depth compensation information, and the residual pipe compliance; and determining a high fidelity wellbore trajectory from the compensated depth measurements and the survey data.

2. The method of claim 1 wherein said depth compensation information comprising at least one of weight on bit, a friction factor, temperature profile, borehole profile, drill string mechanical properties, hookload, and drilling fluid property.

3. The method according to claim 1, further comprising assigning compensated depth measurements to the survey data.

4. The method according to claim 1, wherein correcting the plurality of raw depth measurements for residual pipe compliance further comprises applying an exponential filter.

5. The method according to claim 1, further comprising correcting the plurality of raw depth measurements for rig heave wherein the plurality of compensated depth measurements are calculated from the raw depth measurements, depth compensation information and rig heave.

6. The method according to claim 5, wherein correcting the plurality of raw depth measurements for rig heave further comprises applying a multi-pass median filter.

7. The method according to claim 1, further comprising correcting the plurality of raw depth measurements for tide, wherein the plurality of compensated depth measurements are calculated from the raw depth measurements, depth compensation information and tide.

8. The method according to claim 7, wherein correcting the plurality of raw depth measurements for tide further comprises adjusting the depth measurement by a tide correction factor based on a tide chart.

9. The method according to claim 1, further comprising basing one or more drilling calculations on the high fidelity wellbore trajectory.

10. The method according to claim 9, further comprising providing a steering command based on at least one drilling calculation based on the high fidelity wellbore trajectory; and observing in real time a response of the bottomhole assembly to the steering command.

11. The method according to claim 1, further comprising based on the high fidelity wellbore trajectory, exercising the ability to change from a first drilling mode to a second drilling mode with a reduced impact on survey and trajectory accuracy, log accuracy, and image accuracy.

12. The method according to claim 1, further comprising calculating a formation characteristic based on the high fidelity wellbore trajectory and a physical quantity indicative of a property of the formation.

13. The method according to claim 12, further comprising performing a plurality of measurements of the physical quantity indicative of a property of the formation; and performing an inversion of the plurality of measurements of the physical quantity indicative of the property.

14. The method according to claim 12, further comprising correlating the calculated formation characteristic or measured physical quantity with one or more wireline logs.

15. The method according to claim 12, further comprising generating an earth model based on the high fidelity wellbore trajectory and the physical quantity indicative of a property of the formation.

16. A method for obtaining a high fidelity wellbore trajectory, comprising:

obtaining a plurality of raw depth measurements for a wellbore;

obtaining survey data about a bottom hole assembly;

obtaining depth compensation information;

calculating a plurality of compensated depth measurements from the raw depth measurements, and the depth compensation information;

calculating a sag inclination angle;

correcting the survey data with the sag inclination angle; and determining a high fidelity wellbore trajectory from the compensated depth measurements and the corrected survey data.

17. The method according to claim 16, further comprising reducing time during which drilling is halted based on the high fidelity wellbore trajectory.

18. The method according to claim 16, further comprising reducing time during which pumps are turned off based on the high fidelity wellbore trajectory.

19. The method according to claim 16, further comprising, based on the high fidelity wellbore trajectory, exercising use of brakes in drilling with a reduced impact on survey and trajectory accuracy, log accuracy, and image accuracy.

20. The method according to claim 16, further comprising analyzing production from the wellbore based on the position of the high fidelity wellbore trajectory relative to a given layer in the reservoir.

21. The method according to claim 20 wherein the step of analyzing further comprises, based on the high fidelity wellbore trajectory, determining inclination of the wellbore; and modeling the fluid regime in the wellbore based on the inclination.

22. A method for obtaining a high fidelity wellbore trajectory comprising:

obtaining a plurality of raw depth measurements from a measurement tool positioned on a drill string extending within a wellbore;

obtaining depth compensation information related to the plurality of depth measurements, wherein the depth compensation information includes stretch or compression of the drill string;

correcting the depth measurements based on the depth compensation information;

calculating sag inclination angle and modifying the compensated measurements based on the sag inclination angle, including modifying an inclination or azimuth measurement based on the sag inclination angle;

calculating a high fidelity trajectory of the wellbore from the corrected depth measurements; and steering the drill string based on the high fidelity trajectory.

23. A method for obtaining a high fidelity wellbore trajectory, comprising:

obtaining a plurality of raw depth measurements of a wellbore;

obtaining survey data about a bottom hole assembly;

obtaining depth compensation information;

calculating a plurality of compensated depth measurements from the raw depth measurements and the depth compensation information;

determining a high fidelity wellbore trajectory from the compensated depth measurements and the survey data;

calculating a true vertical depth at a given point in a reservoir based on the high fidelity wellbore trajectory and a physical quantity indicative of a property of the formation;

determining a position of one or more fluid contact boundaries within the formation; and determining whether one of the fluid contact boundaries is flat or tilted as well as the value of the tilt.

* * * * *